US008777400B2

(12) United States Patent
Yamamoto et al.

(10) Patent No.: US 8,777,400 B2
(45) Date of Patent: Jul. 15, 2014

(54) LIQUID EJECTION DEVICE

(71) Applicant: Seiko Epson Corporation, Tokyo (JP)

(72) Inventors: Takao Yamamoto, Nagano (JP); Hirotaka Yoshida, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/762,823

(22) Filed: Feb. 8, 2013

(65) Prior Publication Data

US 2013/0208065 A1 Aug. 15, 2013

(30) Foreign Application Priority Data

Feb. 9, 2012 (JP) ..... 2012-026451

(51) Int. Cl.
*B41J 2/01* (2006.01)
*B41J 11/00* (2006.01)

(52) U.S. Cl.
CPC ..... *B41J 11/0085* (2013.01); *B41J 11/0045* (2013.01)
USPC ..... 347/104; 347/101; 347/16

(58) Field of Classification Search
CPC ..... B41J 11/0045; B41J 11/02; B41J 11/0085
USPC ..... 347/104, 101, 16
See application file for complete search history.

(56) References Cited

U.S. PATENT DOCUMENTS

| | | | | |
|---|---|---|---|---|
| 6,270,215 | B1 | 8/2001 | Miyasaka et al. | |
| 6,927,841 | B2 | 8/2005 | Hinojosa et al. | |
| 7,144,106 | B2 | 12/2006 | Ishii et al. | |
| 7,322,690 | B2 | 1/2008 | Ishii et al. | |
| 7,887,179 | B2 | 2/2011 | Toyoshima | |
| 8,287,119 | B2 * | 10/2012 | Yamaguchi et al. | 347/104 |
| 2007/0291096 | A1 * | 12/2007 | Toyoshima | 347/104 |
| 2011/0074872 | A1 | 3/2011 | Ozaki et al. | |
| 2011/0221843 | A1 | 9/2011 | Ozaki | |

FOREIGN PATENT DOCUMENTS

| | | | |
|---|---|---|---|
| JP | 06-015902 | A | 1/1994 |
| JP | 08-156351 | A | 6/1996 |
| JP | 11-208045 | A | 8/1999 |
| JP | 2001-347691 | A | 12/2001 |
| JP | 2001-347710 | A | 12/2001 |
| JP | 2002-120420 | A | 4/2002 |

(Continued)

OTHER PUBLICATIONS

The extended European Search Report for European Application No. 13154360.5 mailed May 3, 2013.

*Primary Examiner* — Henok Legesse
(74) *Attorney, Agent, or Firm* — Global IP Counselors, LLP

(57) ABSTRACT

A liquid ejection device includes a transport unit, a medium support unit and a liquid ejection head. The medium support unit includes a plurality of first recesses and a plurality of second recesses arranged on a medium support surface along a width direction orthogonal to a transport direction. The first and second recesses are configured and arranged to be imparted with negative pressure. A width dimension of an opening of the first recess in the width direction is larger on the downstream side than on an upstream side. A width dimension of an opening of the second recess in the width direction is smaller than the width dimension of the opening of the first recess in the width direction on the downstream side with respect to the transport direction. The second recesses are configured and arranged to accept the liquid ejected toward the ejection medium from the liquid ejection head.

9 Claims, 6 Drawing Sheets

(56) References Cited

FOREIGN PATENT DOCUMENTS

| | | | |
|---|---|---|---|
| JP | 2003-118180 | A | 4/2003 |
| JP | 2003-118181 | A | 4/2003 |
| JP | 2003-118182 | A | 4/2003 |
| JP | 2003-246524 | A | 9/2003 |
| JP | 2005-219434 | A | 8/2005 |
| JP | 2006-181939 | A | 7/2006 |
| JP | 2006-192836 | A | 7/2006 |
| JP | 2006-231612 | A | 9/2006 |
| JP | 2007-098936 | A | 4/2007 |
| JP | 2007-152737 | A | 6/2007 |
| JP | 2007-260913 | A | 10/2007 |
| JP | 2007-331255 | A | 12/2007 |
| JP | 2009-067015 | A | 4/2009 |
| JP | 2009-119778 | A | 6/2009 |
| JP | 2010-000694 | A | 1/2010 |
| JP | 2010-137399 | A | 6/2010 |
| JP | 2010-269456 | A | 12/2010 |
| JP | 2010-269609 | A | 12/2010 |
| JP | 2011-046110 | A | 3/2011 |
| JP | 2011-088424 | A | 5/2011 |
| JP | 2011-189538 | A | 9/2011 |

* cited by examiner

LIQUID EJECTION DEVICE

CROSS-REFERENCE TO RELATED APPLICATIONS

This application claims priority to Japanese Patent Application No. 2012-026451 filed on Feb. 9, 2012. The entire disclosure of Japanese Patent Application No. 2012-026451 is hereby incorporated herein by reference.

BACKGROUND

1. Technical Field

The present invention relates to a liquid ejection device for ejecting a liquid on an ejection medium that is supported by suction on a medium support unit.

2. Related Art

From the past, inkjet printers (hereafter referred to simply as "printers") have been put to practical use as liquid ejection devices for ejecting ink as a liquid from a liquid ejection head onto paper (ejection medium) in a sheet form supported on a medium support unit, and forming an image containing text or graphics. Among this type of printer, there is a printer that performs so-called "borderless printing" which ejects ink from the liquid ejection head on the entire surface of the paper to form an image.

With a printer that performs this kind of "borderless printing," for example as disclosed in Japanese Laid-Open Patent Application Publication No. 2011-189538, at a medium support unit, ink discarding grooves that accept ink discarded away from the paper end parts ejected from the liquid ejection head are provided at positions according to the width direction end parts that is orthogonal to the transport direction of the supported paper. Also, a plurality of recesses in which are formed suction holes which operate a suction force for suctioning the paper to the medium support unit are provided between the ink discarding grooves. Then, of the recesses provided on the medium support unit, the ink discarding grooves are provided in communication with adjacent recesses in the paper width direction. Therefore, the paper is supported on the medium support unit by being suctioned and adsorbed to both the recesses on which the suction force acts directly and the ink discarding grooves on which the suction force acts indirectly via the recesses.

However, as disclosed in the above mentioned publication, at the medium support unit, while the ink discarding grooves are formed with a large width dimension to be able to reliably accept ink, the recesses in which the suction holes are formed has the width dimension formed to be small to suppress bending (cockling) due to direct action by the suction force on the paper. As a result, with the conventional medium support unit, the recesses are formed with a width dimension formed to be smaller than the width dimension of the ink discarding grooves. By the recesses and the ink discarding grooves being formed in this way, the paper is suctioned on the medium support surface so that it is in a state for which bending deformation (cockling volume) is suppressed.

SUMMARY

However, when paper of different width dimensions is supported on a printer, in addition to a wide ink discarding groove provided according to the end part of a wide paper with a large width dimension, also provided is a narrow width ink discarding groove provided according to the end part of a narrow width paper with a small width dimension. As a result, when this narrow width ink discarding groove is covered by a wide width paper, it is positioned further to the inside than the width direction end part of the wide width paper.

In such a case, with wide width paper support by suction on the medium support unit, though the bending deformation of the paper that occurs in the width direction is smaller at the positions corresponding to the recesses, it can easily become bigger at positions corresponding to the narrow width ink discarding grooves. Also, for example when the paper is swollen due to adhesion of ink ejected from the liquid ejection head during printing, though the bending deformation in the width direction of the paper that accompanies this swelling is also smaller at the recesses, it easily becomes larger at the narrow width ink discarding grooves. Therefore, with the suctioned paper, the bending is concentrated at the larger width ink discarding grooves, and greater bending of the paper occurs more easily at the ink discarding grooves than at the recesses. Because of that, the paper supported on the medium support unit has little bending at the recesses, so the impact displacement volume is small, and the bending at the ink discarding grooves is great, so the impact displacement volume is great. As a result, for example, there is the problem that localized color unevenness occurs in images printed on the paper.

The present invention was created considering the circumstances noted above, and an object is to provide a liquid ejection device for which the bending that occurs in the width direction orthogonal to the transport direction of the ejection medium that is supported by suction on the medium support unit is made uniform.

A liquid ejection device according to one aspect includes a transport unit, a medium support unit and a liquid ejection head. The transport unit is configured and arranged to transport an ejection medium. The medium support unit is arranged on a downstream side of the transport unit with respect to a transport direction of the ejection medium, and having a medium support surface on which the ejection medium is supported by suction using negative pressure when the transport unit transports the ejection medium. The liquid ejection head is configured and arranged to eject liquid on the ejection medium supported on the medium support unit. The medium support unit includes a plurality of first recesses and a plurality of second recesses arranged on the medium support surface along a width direction orthogonal to the transport direction. The first recesses and the second recesses are configured and arranged to be imparted with the negative pressure. A width dimension of an opening of each of the first recesses in the width direction is larger on the downstream side than on an upstream side with respect to the transport direction. A width dimension of an opening of each of the second recesses in the width direction is smaller than the width dimension of the opening of each of the first recesses in the width direction on the downstream side with respect to the transport direction. The second recesses are configured and arranged to accept the liquid ejected toward the ejection medium from the liquid ejection head.

With this arrangement, with the ejection medium that is supported by suction on the upstream side of the transport direction on the medium support surface, as it is transported to the downstream side of the transport direction on the medium support surface, the bending deformation that occurs at the second recess is absorbed by the bending deformation that occurs at the downstream side of the transport direction within the first recess for which the width dimension of the opening is greater than that of the second recess. Therefore, with the ejection medium that is supported by suction on the medium support surface, the bending that occurs in the width direction orthogonal to the transport direction is made uniform.

With the liquid ejection device of the above described aspect, each of the first recesses preferably includes a rib extending from an upstream side edge of the first recess toward the downstream side with respect to the transport direction, and a width dimension between one of edges of the opening of each of the first recesses in the width direction and the rib is preferably smaller than the width dimension of the opening of each of the second recesses.

With this arrangement, at the upstream side of the transport direction of the medium support surface at which suction of the ejection medium is started, it is possible to suppress bending deformation of the ejection medium at the first recesses that occurs in the width direction orthogonal to the transport direction by using the ribs. As a result, at the first recesses, since it is supported on the medium support surface suctioned in a state with bending deformation suppressed, the ejection medium is supported at a suitable position on the medium support surface.

With the liquid ejection device of the above described aspect, an upstream side edge of the opening of each of the second recesses with respect to the transport direction is preferably positioned on the upstream side than an upstream side edge of the opening of each of the first recesses with respect to the transport direction.

With this arrangement, the liquid ejected from the liquid ejection head can be accepted with high reliability at the second recesses. Therefore, soiling of the medium support surface by the liquid is suppressed.

With the liquid ejection device of the above described aspect, the second recesses are arranged at positions respectively corresponding to end parts of the ejection medium in the width direction.

With this arrangement, it is possible to accept the liquid, which is ejected from the liquid ejection head at a position sticking out further than the end parts of the ejection medium, by the second recesses. Therefore, soiling of the medium support surface by liquid is suppressed.

With the liquid ejection device of the above described aspect, at least one of the first recesses includes a suction hole in communication with a negative pressure generating unit that generates the negative pressure.

With this arrangement, negative pressure is imparted to the first recess via the suction hole provided in the first recess, so it is possible to reliably generate bending deformation on the ejection medium at the first recess.

BRIEF DESCRIPTION OF THE DRAWINGS

Referring now to the attached drawings which form a part of this original disclosure:

FIG. 4A is a partial plan view of the medium support surface, FIG. 4B is a cross section view taken along a section line 4*b*-4*b* in FIG. 4A, and FIG. 4C is a cross section view taken along a section line 4*c*-4*c* in FIG. 4A.

FIG. 5A is a partial plan view of the medium support surface, FIG. 5B is a cross section view taken along a section line 5*b*-5*b* in FIG. 5A, and FIG. 5C is a cross section view taken along a section line 5*c*-5*c* in FIG. 5A.

DETAILED DESCRIPTION OF EXEMPLARY EMBODIMENTS

Figure 1:
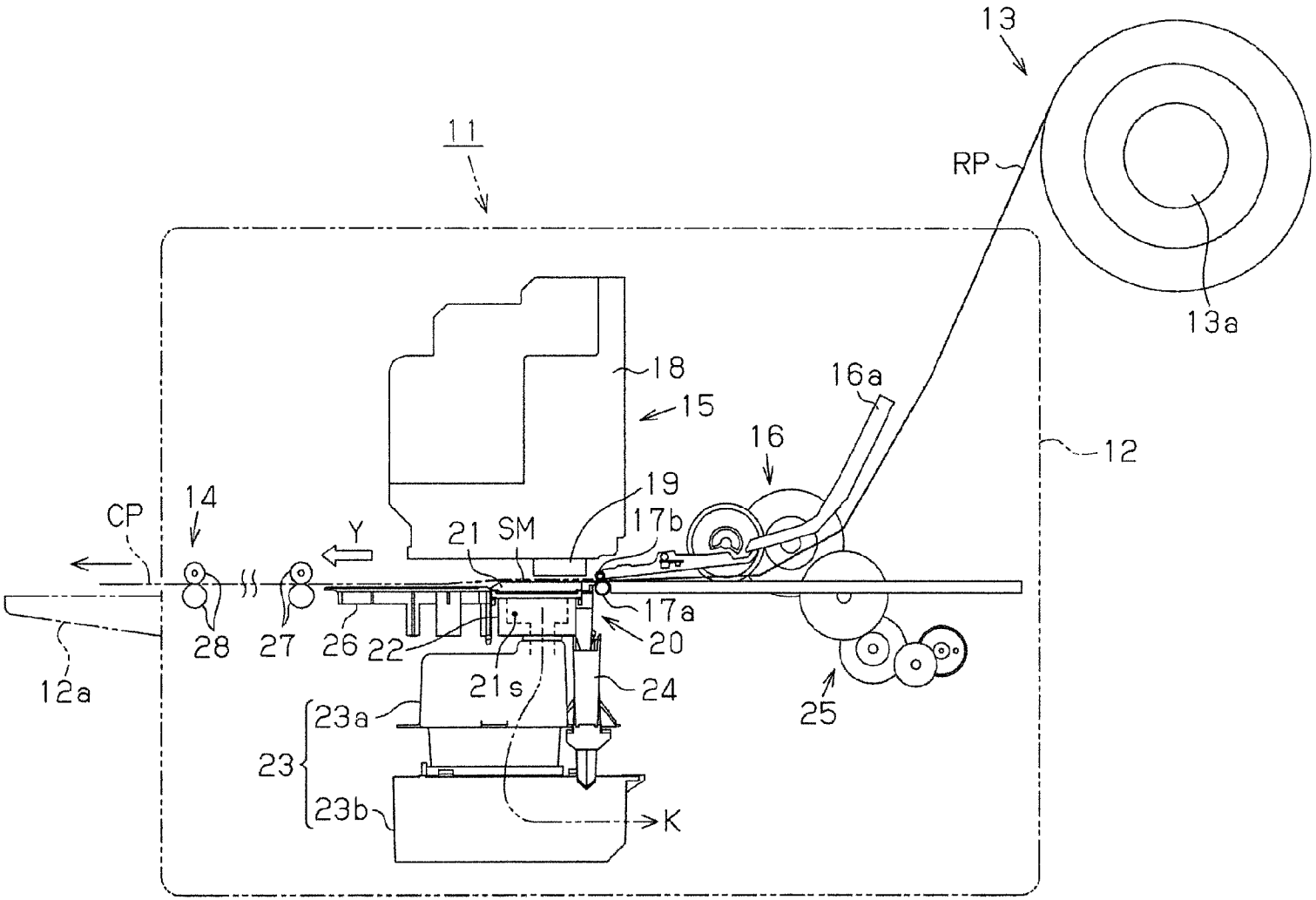
FIG. 1 is a schematic block diagram of a liquid ejection device which is an embodiment of the present invention.

Following, as an embodiment with the present invention in a specific example, we will describe an inkjet printer (hereafter referred to simply as "printer") as an example of a liquid ejection device, equipped with a liquid ejection head for ejecting liquid, for forming (printing) an image or the like containing text or graphics by ejecting liquid on paper (roll paper) as an ejection medium, while referring to the drawings.

As shown in FIG. 1, the printer 11 has a main unit case 12, and a paper supply unit 13 with the long sheet form paper RP supplied to the main unit case 12 equipped in a rolled state wound onto a roll shaft 13*a*. Equipped inside the main unit case 12 are a liquid ejection unit 15 that ejects liquid on the supplied paper RP to form an image or the like, and a paper ejection unit 14 for ejecting from a paper ejection port provided on the main unit case 12 to a paper ejection tray 12*a* the paper RP on which an image or the like is formed as cut paper CP.

The paper supply unit 13 has the paper RP equipped so as to be able to rotate with a roll shaft 13*a* at the center on the side opposite to the paper ejection unit 14, and supplies the paper RP into the main unit case 12. Inside the main unit case 12 is provided a transport path 16 equipped with a guide member 16*a* or the like by which the end part of the paper RP is guided. The end part of the paper RP which is supplied unwound from its rolled state as the roll shaft 13*a* is rotated is transported along this transport path 16, and in the transport path 16, is fed between a pair of rollers consisting of a paper feed roller 17*a* provided at the back end of the transport direction and a paper pressing roller 17*b* which is driven by the rotation of this paper feed roller 17*a*. While being sandwiched by the paper feed roller 17*a* driven by a drive source (motor, not illustrated) and the paper pressing roller 17*b*, the paper RP is transported to the liquid ejection unit 15 side which is positioned at the transport direction downstream side. Therefore, with this embodiment, the paper feed roller 17*a* and the paper pressing roller 17*b* function as a transport unit.

The liquid ejection unit 15 is equipped with a carriage 18 on the upper side (antigravity direction side) of the transported paper RP. The carriage 18 is supported on a guide shaft (not illustrated) that is erected within the main unit case 12 in a state extending in a roughly horizontal direction along the width direction of the paper RP orthogonal to the transport direction (direction between the paper front side and back side in FIG. 1), and is able to move along the guide shaft. A liquid ejection head 19 is attached to the bottom surface side facing opposite the paper RP transported to the carriage 18. A plurality of nozzles (not illustrated) for ejecting ink which is an example of the liquid are provided on the liquid ejection head 19, and by the carriage 18 moving back and forth along the width direction of the paper RP while being guided by the guide shaft, these move back and forth together with the carriage 18 in the direction along the guide shaft (also called the main scan direction X).

Also, the printer 11 is equipped with a medium support unit 20 that sandwiches the transported paper RP and supports the paper RP from the lower side (gravity direction side) at a position facing the liquid ejection head 19. The medium support unit 20 is equipped with a roughly rectangular shaped surface for which the main scan direction X is the long direction on the top surface facing opposite the liquid ejection head 19, and the paper RP is supported by suction on this top surface by negative pressure given to the medium support unit 20.

Specifically, the medium support unit 20 is equipped on its top surface with a roughly plate shaped support surface forming member 21 formed as a medium support surface SM supporting the paper RP transported in the transport direction Y (white outline arrow direction in the drawing), and a support unit frame member 22 joined and fixed to the bottom surface side which is the side opposite to the medium support surface SM. Then, an interior space is formed by the joined support surface forming member 21 and the support unit frame member 22, and this interior space functions as a negative pressure chamber 21*s* to which negative pressure is given in order to suction the paper RP to the medium support surface SM.

Also, with this embodiment, a negative pressure generating unit 23 connected so as to be in communication with the negative pressure chamber 21*s*, consisting of a suction chamber 23*a* for suctioning air from the negative pressure chamber 21*s* and a rotating fan 23*b*, is provided on the bottom side of the medium support unit 20. Therefore, the negative pressure generated at the negative pressure generating unit 23 by the air (atmosphere) rotated by the rotating fan 23*b* flowing as shown by the double-dot-dash line arrow K in the drawing is given to the negative pressure chamber 21*s*.

Then, on the front surface of the paper RP supported by suction on the medium support unit 20 (the top surface in FIG. 1), by ink being ejected from the liquid ejection head 19, formation (printing) of an image or the like is performed by adhering of ink on the paper RP. When performing borderless printing with the printer 11, on the medium support unit 20, an ink discharge unit 24 by which ink ejected on the medium support unit 20 is discharged is provided.

Also, inside the main unit case 12, further to the transport direction Y downstream side than the medium support unit 20 (support surface forming member 21), are equipped a guide plate 26 and intermediate roller pair 27 for transporting the paper RP from the medium support unit 20 side to the paper ejection unit 14 side. Further equipped is a paper ejection roller pair 28 for ejecting paper RP from the paper ejection port to the paper ejection tray 12*a*. Provided as necessary between the intermediate roller pair 27 and the paper ejection roller pair 28 are a cutter for cutting the paper RP after image formation to a cut paper CP of a designated length, and further to the transport direction Y downstream side than the cutter, a drying device for drying ink by blowing warm air (drying air) on the printed surface of the cut paper CP, and the like.

Furthermore, with the printer 11, for example in cases such as when exchanging the paper RP with a different paper RP of a different width dimension, reversing the roll shaft 13*a* and returning the paper RP from the liquid ejection unit 15 to the direction opposite to the transport direction Y are performed. At that time, a release mechanism 25 for releasing such that the paper pressing roller 17*a* is separated from the paper feed roller 17*a* is equipped using a gear train or the like.

Now then, with the printer 11 of this embodiment, the constitution is such that when the paper RP transported on the medium support unit 20 is suctioned to the medium support surface SM, the bending deformation that occurs with the paper RP is made to be uniform. We will describe this constitution while referring to FIG. 2 and FIG. 3.

Figure 2:
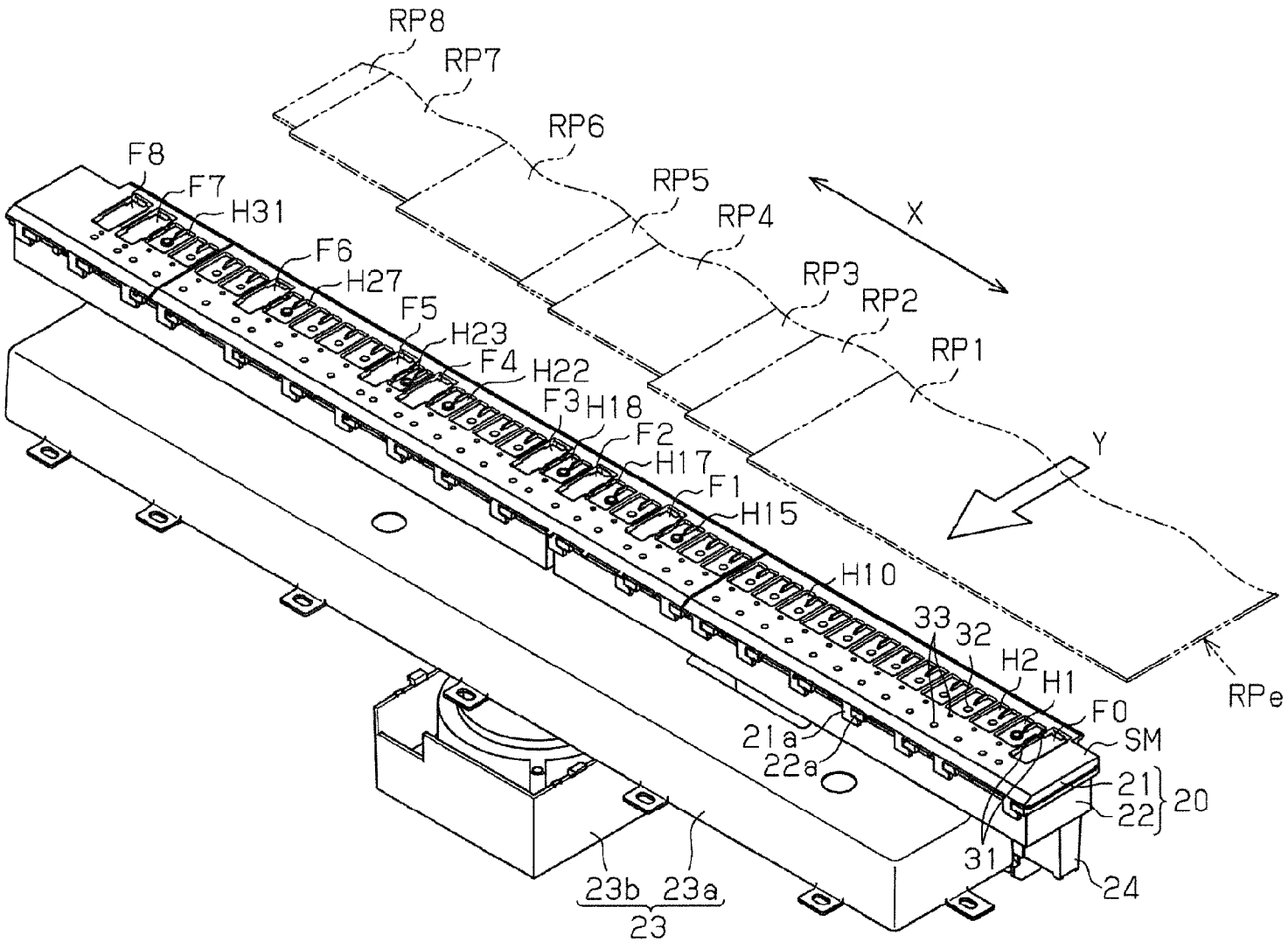
FIG. 2 is a perspective view showing a medium support unit equipped with a liquid ejection device of this embodiment.

As shown in FIG. 2, the medium support unit 20 is formed with a support unit frame member 22 having roughly a box shape open upward attached to the roughly plate shaped support forming member 21 for which the top surface side functions as the medium support surface SM. With this embodiment, a hook shaped member 21*a* provided on the support surface forming member 21 is engaged with a projection site 22*a* in the vicinity of the opening of the support unit frame member 22, and the support unit frame member 22 is joined and fixed to the support surface forming member 21.

On the medium support surface SM, a plurality of first recesses Hm (m=1 to 31) and second recesses Fn (n=0 to 8), which are respectively formed with designated volume depressions downward so as to be open at the medium support surface SM and also to be separated from the supported paper RP, are provided aligned in the width direction orthogonal to the transport direction Y of the paper RP (hereafter also simply called "width direction"). Specifically, with this embodiment, as shown in FIG. 2, nine second recesses Fn (F0 to F8) are provided with a designated interval left open at positions corresponding to the respective width direction end parts of eight types of paper RP (RP1 to RP8) for which the width dimensions differ. Of these, the second recess F0 provided furthest to the left side seen from the upstream side of the transport direction Y is provided at a position for which all the respective end parts RPe of the left side seen from the transport direction Y upstream side correspond in common for the paper RP supported on the medium support unit 20. Said another way, each paper RP is transported on the medium support unit 20 in a state with all the end parts RPe of one of the papers RP moved to one side to the left side seen from the transport direction Y upstream side so as to all be at the same position.

Then, among these nine second recesses Fn, between two second recesses Fn aligned with a gap open, a designated number of first recesses Hm are provided in parallel at almost the same pitch. For example, fifteen first recesses Hm from first recess H1 to first recess H15 are provided in parallel between the second recess F0 and the second recess F1. With this embodiment, due to manufacturing reasons and the like, the support surface forming member 21 having the medium support surface SM is constituted by three partitioned members. Of course, it is also possible to constitute this with one member that is not partitioned.

Suction holes 32 in communication with the negative pressure chamber 21*s* are provided on all the first recesses Hm provided on the medium support surface SM, and each first recess Hm is in communication via the suction holes 32 with the negative pressure generating unit 23 which generates negative pressure. Also, each of the second recesses Fn is in communication with the adjacent first recess Hm on the inside of the paper RP among each of the first recesses Hm covered by the paper RP, via the groove part 31 formed lowered by a designated volume from the medium support surface SM, and the negative pressure of the negative pressure chamber 21*s* given to the first recess Hm is given via this groove part 31. Therefore, the paper RP is suctioned by the first recesses Hm and the second recesses Fn including the end parts. Also, so as to have stable suction of the paper RP to the medium support surface SM even at the surface area at which first recesses Hm and second recesses Fn are not provided, the suction holes 33 in communication with the negative pressure chamber 21*s* are provided at suitable locations (e.g. positions aligned along the suction holes 32 and the transport direction Y).

Figure 3A:
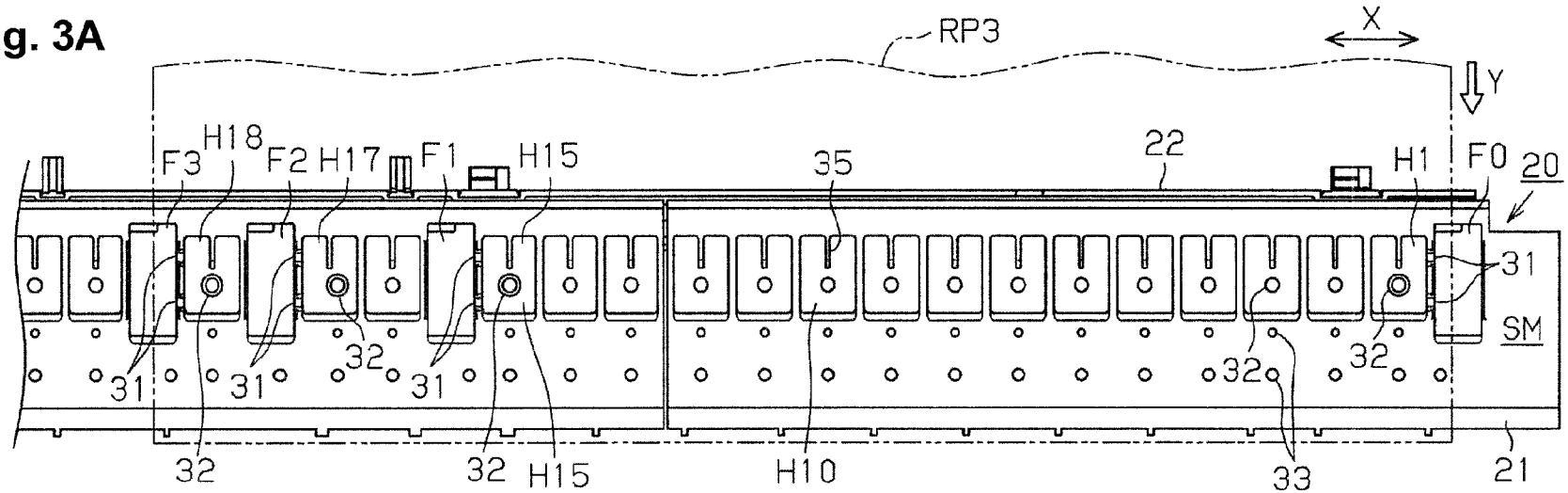
FIG. 3A is a plan view showing a portion of a medium support unit having a medium support surface on which first recesses and second recesses are provided with a normal line direction view of the medium support surface.
Figure 3B:
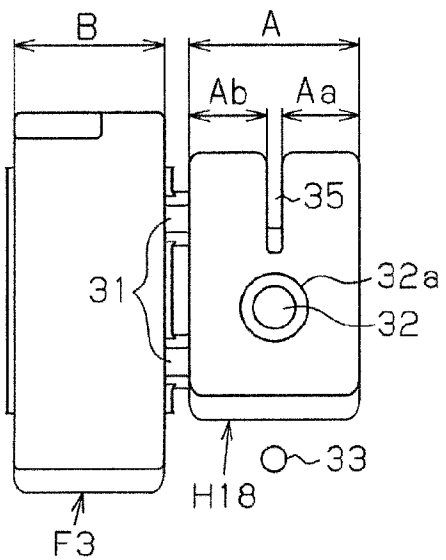
FIG. 3B and FIG. 3C are plan views with the first recesses and second recesses enlarged.
Figure 3C:
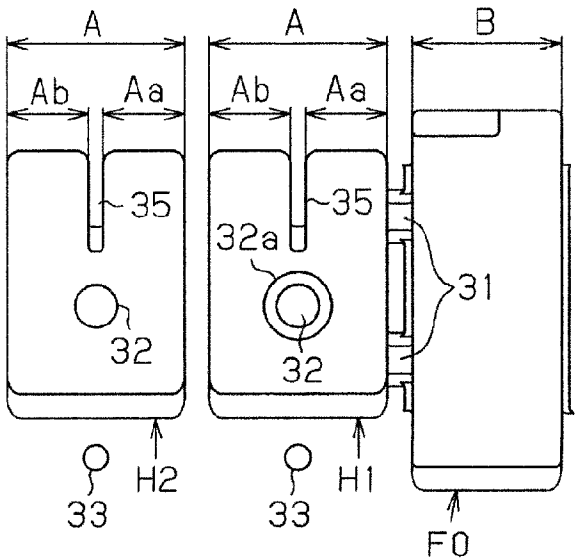

Next, we will describe the first recesses Hm and the second recesses Fn while referring to FIGS. 3A, 3B and 3C. Here, we will describe an example for which the paper RP transported on the medium support unit 20 is paper RP3. Also, in FIG. 3A, the illustration omits the first recess Hm and the second recess Fn positioned further to the left side than the paper RP3 seen from the front side of the transport direction Y of the medium support unit 20 (support surface forming member 21).

As shown in FIG. 3A, there are a second recess F1 and second recess F2 for which the openings are covered by the paper RP3 in the width direction orthogonal to the transport direction Y (white outline arrow in the drawing) between the second recess F0 and the second recess F3 respectively provided at positioned corresponding to the end parts of the transported paper RP3. Then, fifteen first recesses Hm are provided between the second recess F0 and the second recess F1, two first recesses Hm are provided between the second recess Fn and the second recess Fn, and one first recess Hm is provided between the second recess Fn and the second recess Fn.

With this embodiment, four second recesses Fn (F0, F1, F2, F3) are all formed depressed in roughly the same manner from the medium support surface SM, and at least the width dimension B of the width direction has the same roughly rectangular shaped openings at the medium support surface SM. In contrast to this, all of the first recesses Hm are similarly formed with roughly the same depression from the medium support surface SM, and at the medium support surface SM, for all the first recesses Hm, the width dimension A of the opening has a larger rectangular opening shape than the width dimension B of the opening of the second recesses Fn. The opening of the first recesses Hm is formed with approximately equal length as the ejection area of the ink ejected from the liquid ejection head 19 in the transport direction Y. The opening of the second recesses Fn is formed at a length that is a broader area than the ejection area of the ink in the transport direction Y to be able to reliably accept the ink ejected from the liquid ejection head 19. In addition, the first recesses Hm and the second recesses Fn have the depressed part at the transport direction downstream side edge of the respective openings formed as a sloped surface so that the paper RP is transported smoothly without catching on something.

Furthermore, with this embodiment, ribs 35 are provided extending from the transport direction Y upstream side edge at the opening of the first recess Hm toward the transport direction Y downstream side. With the ribs 35, the upstream side of the transport direction Y at the first recess Hm has the dimension between both edges in the width direction at the opening of the first recesses Hm and the rib 35 formed to be smaller than the width dimension of the opening of the second recesses Fn. Said another way, between the second recesses Fn provided with a gap open on the medium support surface SM, the first recesses Hm are provided with the opening width dimension larger than the second recesses Fn, and set to an item count for which the width dimensions Aa and Ab between the rib 35 provided on the transport direction Y upstream side at that opening and both edges of the opening will be less than the second recesses Fn.

Incidentally, with this embodiment, as shown in FIG. 3B, paper RP with a 13 inch width dimension is transported, and the second recess F3 corresponding to one end part at the width direction right side facing the transport direction Y is formed having an opening for which the width dimension B is approximately 12 millimeters at the medium support surface SM. Meanwhile, the width dimension A of the first recess H18 adjacent to the second recess F3 is formed at approximately 14 millimeters which is greater than 12 millimeters. Also, the opening of the transport direction Y upstream side at the first recess H18 is partitioned by a rib 35 into two opening parts for which the width dimension Aa and the width dimension Ab are respectively approximately 5.5 millimeters.

Also, as shown in FIG. 3C, the second recess F0 corresponding to the other end part of the width direction left side facing the transport direction Y of the paper RP3 is formed having an opening for which the width dimension B is similarly 12 millimeters at the medium support surface SM. Of course, this second recess F0 is provided corresponding to one end part of the left side facing the transport direction Y for all of the transported paper RP. Meanwhile, the first recess H1 adjacent to the second recess F0 is formed having an opening with a width dimension of approximately 14 millimeters which is greater than the second recess F0. Also, the opening of the upstream side of the transport direction Y of the first recess H1 (and the first recess H2) is partitioned by a rib 35 into two opening parts for which the first width dimension Aa and the width dimension Ab are respectively approximately 5.5 millimeters.

In this way, the width dimension of the width direction of the opening of the first recesses Hm is formed as a larger dimension than the width dimension of the width direction of the opening of the second recesses Fn. Then, with this embodiment, depending on the number of items set between all the second recesses Fn provided on the medium support surface SM, the first recesses Hm are formed with the width dimension A of the opening having a value between approximately 13.5 to 15.4 millimeters.

The end part of the width direction of the paper RP supported on the medium support unit 20 is suctioned at the medium support surface SM such that at the opening of width dimension 12 millimeters of the corresponding second recess Fn, it is at a position separated by approximately 4.5 millimeters from the edge of the opening positioned inside the paper RP. Also, so as to reliably accept ink ejected from the liquid ejection head 19, the second recesses Fn are formed with long openings for which the opening edge has respectively designated dimensions (here, approximately 3 to 6 millimeters) in both the upstream side and the downstream side directions of the transport direction in relation to the openings of the first recesses Hm.

Also, as shown in FIGS. 3B and 3C, between the adjacent first recess H18 and the second recess F3, and between the first recess H1 and the second recess F0, the depression formed parts are connected together by two groove parts 31 that respectively drop by a designated volume from the medium support surface SM, and these are in communication with each other by formation of a space in a state with the paper RP3 supported on the medium support surface SM. Because of this, the paper RP3 to which a negative pressure is given via the groove part 31 from the suction hole 32 of the first recess H18 is suctioned to the second recess F3. Also, the paper RP3 given a negative pressure via the groove part 31 from the suction hole 32 of the first recess H1 is suctioned to the second recess F0.

For the other second recess Fn provided corresponding to the end part in the width direction of the paper RP, similarly, these are in communication via the adjacent first recess Hm and the groove part 31 inside the covered paper RP, and furthermore, the end part of the paper RP given the negative pressure of the negative pressure chamber 21*s* from the first recess Hm via this groove part 31 is suctioned. On the suction hole 32 provided on the first recess Hm in communication via the groove part 31 with the second recess Fn, a wall part 32*a* is formed that suppresses the inflow of floating ink that has become mist around that hole.

Figure 4A:
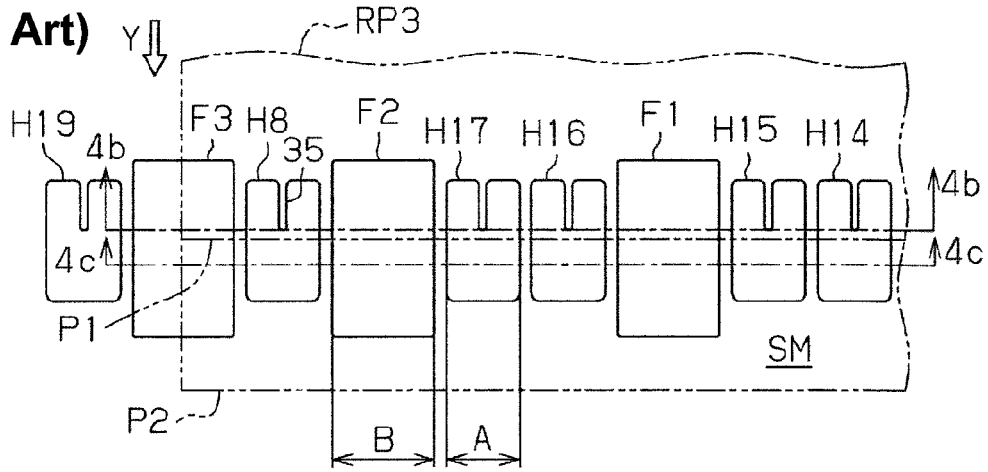
Fig. 4A (Prior Art)
FIGS. 4A to 4C include pattern diagrams showing the state with paper transported on a medium support surface of a prior art medium support unit, where
Figure 4B:
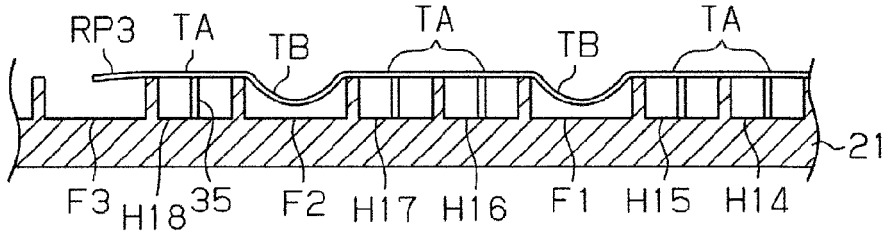
Fig. 4B (Prior Art)
Figure 4C:
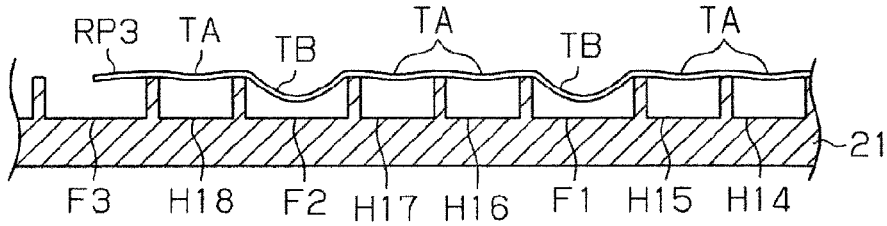
Fig. 4C (Prior Art)
Figure 5A:
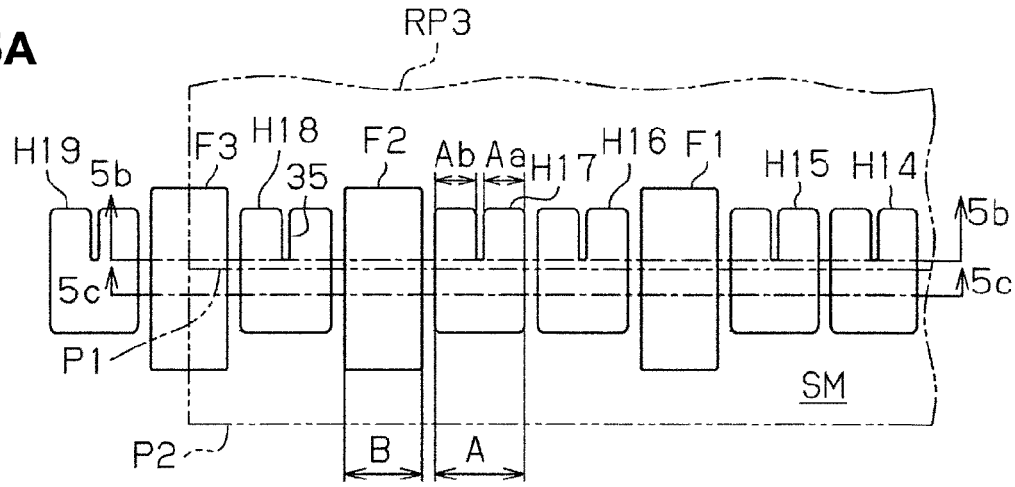
FIGS. 5A to 5C include pattern diagrams showing the state with paper transported on a medium support surface of the medium support unit of this embodiment, where
Figure 5B:
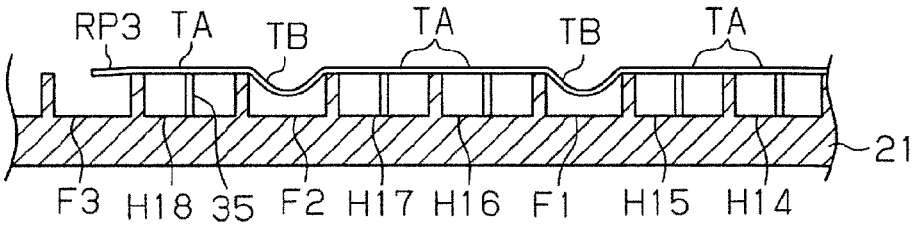
Figure 5C:
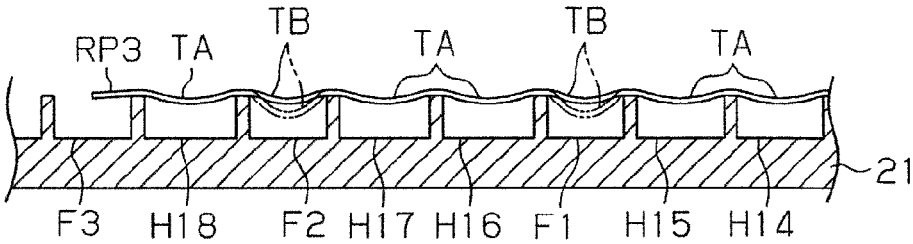

Next, we will describe the action by the medium support unit 20 of this embodiment for which the first recesses Hm and the second recesses Fn are formed in this way on the medium support surface SM on the transported paper RP while referring to FIGS. 5A, 5B, and 5C. Before describing the action of this embodiment, for a comparison with the action of this embodiment, we will describe the action on the paper RP transported supported on the prior art medium support unit 20 while referring to FIGS. 4A, 4B, and 4C. Also, with the description below, in FIGS. 4A, 4B, and 4C, and FIGS. 5A, 5B, and 5C, the paper RP3 is transported, and the first recesses H14 to H19 and second recesses F1 to F3 are schematically shown in a state with the depression depth exaggerated.

As shown in FIG. 4A, with the prior art medium support unit 20, all of the second recesses Fn provided on the medium support surface SM are formed depressed downward in roughly the same way from the medium support surface SM, and have a roughly rectangular shaped opening for which at least the width dimension B of the width direction is equal at the medium support surface SM. Meanwhile, each of the first recesses Hm provided between the second recesses Fn similarly are formed depressed downward in roughly the same way from the medium support surface SM, and all the first recesses Hm have roughly rectangular shaped openings for which the width dimension A is smaller than the width dimension B of the second recesses Fn at the medium support surface SM.

Also, with the prior art medium support unit 20, at the opening of the first recesses Hm, a rib 35 of a designated width is provided extending from the edge of the opening of the transport direction Y upstream side toward the transport direction Y downstream side. With this rib 35, at the transport direction Y upstream side of the opening of the first recesses Hm, the respective width dimensions between both edges of the first recesses Hm and the ribs 35 positioned in the width direction are smaller than the width dimension A of the transport direction Y downstream side at the opening of the first recesses Hm.

Therefore, in a state with the paper RP3 suctioned to the upstream side of the first recesses Hm for which transport has started on the medium support surface SM (the state shown by code number P1 in FIG. 4A), as shown in FIG. 4B, the downward bending deformation TA of the paper RP3 that occurs due to suction at the first recesses Hm (e.g. first recess H17) for which the opening width dimension is small is suppressed to a low level. Meanwhile, at the openings of the second recesses Fn covered by the paper RP3, specifically, second recesses F1 and F2 corresponding to the end parts of papers RP1 and RP2 of narrower width than the paper RP3, the width dimension B of the width direction is large, so with the paper RP3, the downward bending deformation TB generated by suction becomes greater.

In a state for which the paper RP3 is transported further to the downstream side from this state, and the paper RP3 is suctioned at the transport direction Y downstream side of the opening of the first recesses Hm (the state shown by code number P2 in FIG. 4A), as shown in FIG. 4C, for the width direction width dimension of the opening of the first recess Hm (e.g. first recess H17), the downstream side is larger than the upstream side. However, the width direction width dimension A of the opening of the first recess Hm is smaller than the width dimension B of the second recess Fn, so for the paper RP3, the downward bending deformation TA due to suction occurs at a lower level than the bending deformation TB at the second recess Fn. Therefore, the state of the downward bending deformation TB occurring at a high level due to suction at the second recess Fn covered by the paper RP3 is maintained. As a result, with the ink ejected from the liquid ejection head 19, because the impact displacement volume at the second recess Fn for which the bending deformation is high become large, localized color unevenness occurs on the image printed on the paper RP3, for example. Furthermore, even when the paper RP3 is swollen due to impacted ink, the bending that occurs at the wide opening width second recesses Fn is greater than the bending the occurs with the first recesses Hm, so there is a low probability of the bending of the second recesses Fn decreasing.

In contrast to this, as shown in FIG. 5A, with the medium support unit 20 of this embodiment, with the openings of each of the second recesses Fn formed as depressions on the medium support surface SM, there is a roughly rectangular shaped opening for which the width direction width dimension B is smaller than the width dimension B of the opening of the prior art second recesses Fn. Furthermore, there is a roughly rectangular shaped opening for which the width dimension A of the opening of each of the first recesses Hm formed as depressions on the medium support surface SM is greater than the width dimension A of the opening of the first recesses Hm of the prior art.

Therefore, the paper RP3 starts being transported on the medium support surface SM, and in the state for which the paper RP is suctioned at the transport direction Y upstream side at the opening of the first recesses Hm (the state shown by code number P1 in FIG. 5A), as shown in FIG. 5B, the paper RP3 is more greatly bent at the first recesses Hm than with the prior art first recesses Hm. However, the transport direction Y upstream side width dimension at the opening of the first recesses HM is made smaller by being partitioned by the rib 35, so the downward bending deformation TA that occurs due to suction is suppressed to be small. Meanwhile, though downward bending deformation TB occurs due to suction at the second recesses Fn covered by the paper RP3, this is suppressed so as to occur at a lower level than the downward bending deformation TB that occurs with the prior art second recesses Fn.

From this state, the paper RP3 is further transported to the transport direction Y downstream side, and in a state for which the paper RP3 is suctioned at the transport direction Y downstream side of the opening of the first recesses Hm (the state shown by code number P2 in FIG. 5A), as shown in FIG. 5C, at the first recesses Hm, the width dimension of the opening is greater than at the upstream side. At this time, with the first recesses Hm, the width dimension A of the opening is greater than with the width dimension B of the opening of the second recesses Fn, so with the paper RP3, downward bending deformation TA due to suction occurs at a greater level than the bending deformation TB with the second recesses Fn. Therefore, the downward bending deformation TB due to suction that occurs with the second recesses Fn covered by the paper RP3 is absorbed by the bending deformation TA at the first recesses Hm, and the overall bending deformation TA and TB becomes uniform on the medium support surface SM.

The bending at the second recesses Fn having openings with a small width dimension when the paper RP3 is swollen due to impacted ink is suppressed more than the bending of the first recesses Hm having openings with a large width dimension, so the bending deformation TB of the second recesses Fn due to suction becoming even larger due to swelling is suppressed. Therefore, together with the deformation due to this swelling, the bending deformation TB that occurs with the second recesses Fn is absorbed by the bending deformation TA of the first recesses Hm that occurs due to suction.

With the embodiment noted above, it is possible to obtain effects such as the following.

(1) With the paper RP supported by suction at the transport direction Y upstream side on the medium support surface SM, the bending deformation that occurs at the second recesses Fn is absorbed by the bending deformation that occurs at the transport direction downstream side within the first recesses Hm for which the opening width dimension is larger than that of the second recesses Fn as it is transported to the transport direction Y downstream side on the medium support surface SM. Therefore, with the paper RP supported by suction on the medium support surface SM, the bending that occurs in the width direction is made uniform. As a result, the impact displacement volume on the second recesses Fn and the first recesses Hm of the ink ejected from the liquid ejection head 19 is suppressed. Also, the occurrence of large bending deformation on the paper RP is suppressed, so suppression is done such that there is no contact with the liquid ejection head 19.

(2) At the transport direction Y upstream side of the medium support surface SM for which suction of the paper RP has started, it is possible to suppress bending deformation of the paper RP that occurs in the width direction at the first recesses Hm using the ribs 35. As a result, at the first recesses Hm, because the paper RP is supported on the medium support surface SM by suction in a state with the bending deformation suppressed, it is supported at a suitable position in relation to the medium support surface SM.

(3) The transport direction Y upstream side edge at the openings of the second recesses Fn is positioned further to the transport direction Y upstream side than the transport direction Y upstream side edge at the openings of the first recesses Hm, so it is possible to accept the ink ejected from the liquid ejection head 19 with high reliability at the second recesses Fn. Therefore, soiling by the ink of the medium support surface SM is suppressed.

(4) The second recesses Fn are arranged at positions corresponding to the width direction end parts of the paper RP, so it is possible to accept ink ejected from the liquid ejection head 19 positioned sticking out further than the end parts of the paper RP at the second recesses Fn. Therefore, soiling by ink of the medium support surface SM is suppressed.

(5) The first recesses Hm are equipped with suction holes 32 in communication with the negative pressure generating unit 23 that generates negative pressure, so negative pressure is given to the first recesses Hm via the suction holes 32 provided in the first recesses Hm. Therefore, it is possible to have bending deformation occur reliably on the paper RP at the first recesses Hm.

The embodiment noted above can be modified as noted below.

Figure 6A:
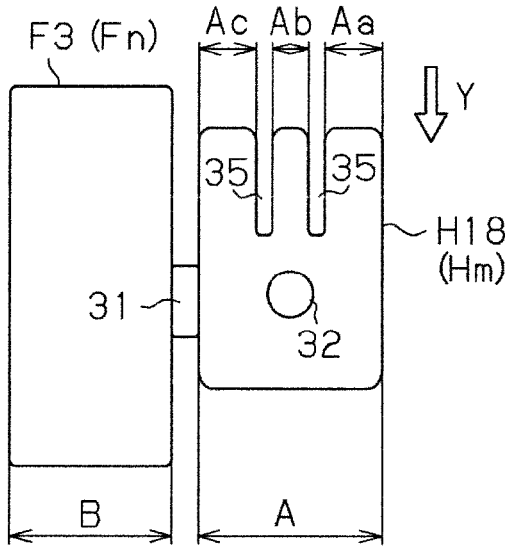
FIGS. 6A and 6B are both plan views showing modification examples of the shape of the first recess.

With the embodiment noted above, the shape of the first recesses Hm is not limited to the shape shown in FIGS. 3B and 3C, and can also be a different shape. For example, as shown in FIG. 6A, the first recess H18 (Hm) can also have a shape formed with a plurality (here, two) of ribs 35 formed facing the transport direction Y downstream side from the transport direction Y upstream side edge of the opening. By doing this, it is possible to make the width dimensions Aa, Ab, and Ac of the openings at the transport direction Y upstream side of the first recess H 18 (Hm) be significantly smaller than the width dimension A at the transport direction Y downstream side. Specifically, while the opening has a narrow width at the transport direction Y upstream side, it is easy to form a recess having an opening with a width wider with than the opening of the width dimension B of the second recess F3 (Fn) in the transport direction Y downstream side.

Figure 6B:
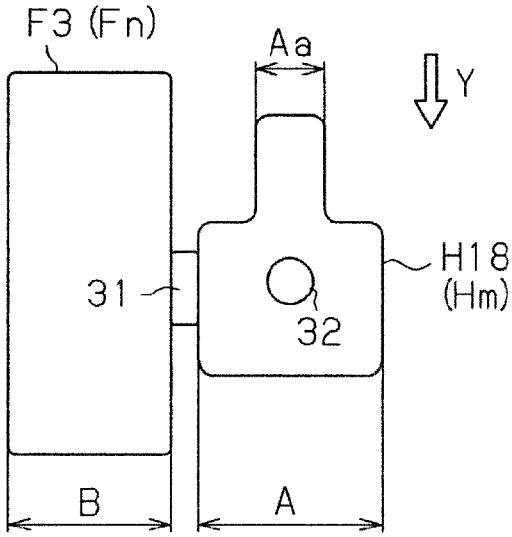

Alternatively, as shown in FIG. 6B, the opening of the first recess H18 (Hm) can also have a shape for which the width dimension of the transport direction Y upstream side is smaller than that of the transport direction Y downstream side. By doing this, it is possible to freely make the width dimension Aa of the opening at the transport direction Y upstream side of the first recess H18 (Hm) smaller than the width dimension A at the transport direction Y downstream side without forming the ribs 35. Specifically, while having an opening with a small width dimension without forming the ribs 35 at the transport direction Y upstream side, it is possible to form a recess having an opening with a larger width dimension than the opening of the width dimension B of the second recess F3 (Fn) at the transport direction Y downstream side.

With the embodiment noted above, the first recesses Hm do not absolutely have to be equipped with suction holes 32 in communication with the negative pressure generating unit 23 for generating negative pressure. For example, the same as with the second recesses Fn, with a portion of the first recesses Hm, it is also possible to be in communication with the suction holes 32 provided on another first recess Hm using a groove part 31 formed on the adjacent other first recesses Hm and the medium support surface SM.

With the embodiment noted above, it is also possible to not necessarily have the second recesses Fn arranged at positions corresponding to the width direction end parts orthogonal to the transport direction Y of the paper RP. For example, when ink is ejected on the medium support surface SM regardless of whether it is borderless printing, it is sufficient to form the second recesses Fn at positions at which this ink is ejected on the medium support surface SM.

With the embodiment noted above, the transport direction Y upstream side edge of the openings of the second recesses Fn does not absolutely have to be positioned to the transport direction Y upstream side from the transport direction Y upstream side edge of the openings of the first recesses Hm. For example, these can also be at the same position. Specifically, it is sufficient to be a position for which it is possible to accept the ink ejected from the liquid ejection head 19.

With the embodiment noted above, it is also possible for the second recesses Fn to be equipped with an absorptive material that absorbs ejected ink. By doing this, it is possible for the ink ejected from the liquid ejection head 19 to be accepted reliably at the second recesses Fn. Therefore, soiling by ink of the medium support surface SM is suppressed at a high ratio, so for example, soiling of the transported paper RP covering the second recesses Fn is suppressed.

With the embodiment noted above, the ejection medium is not limited to being paper (roll paper), and can also be a sheet type member which uses a material such as a metal plate, resin plate, fabric or the like. As long as it is a member for which it is possible to form an image or the like using the liquid ejected from the liquid ejection head 19, it can be used as the ejection medium.

With the embodiment noted above, with the liquid ejection head 19, the liquid storage container in which the ejected liquid is housed can be an on-carriage type which is placed on the carriage 18, or the liquid storage container can also be an off-carriage type which is not placed on the carriage 18. Alternatively, this is not limited to being a serial type printer for which the carriage 18 moves in the main scan direction X, but can also be a line head type printer for which it is possible to do maximum width range printing of the paper RP even with the liquid ejection head 19 remaining fixed.

With the embodiment noted above, the liquid ejection device was put into specific form as the printer 11 for ejecting ink as the liquid, but it is also possible to make it into a specific form as a liquid ejection device that ejects or discharges a liquid other than ink. Various types of liquid ejection device equipped with a liquid ejection head or the like for discharging tiny volume droplets can be appropriated for this. Droplets means the state of liquid discharged from the aforementioned liquid ejection device, and includes granular shapes, tear shapes, and threadlike shapes with a tail. Also, what is called liquid here is sufficient as long as it is a material that can be ejected by the liquid ejection device. For example, it is sufficient as long as it is an item in a state when the property is liquid phase, and includes not only liquid bodies with high or low viscosity, fluid bodies such as sol, gel water, other inorganic solvents, organic solvents, solutions, liquid resin, liquid metal (metal melt), or a liquid as one state of a substance, but also includes items such as items for which particles of functional materials consisting of a solid such as a pigment, metal particle or the like is dissolved, dispersed, or blended in a solvent. Also, as a representative example of a liquid, we can list the ink or liquid crystal or the like such as those described with the embodiment noted above. Here, ink includes typical water based inks, oil based inks, as well as various liquid compositions such as gel ink, hot melt ink and the like. As a specific example of the liquid ejection device, for example, there are liquid ejection devices which eject liquid including materials such as electrode materials or coloring materials or the like in a dispersed or dissolved form used in manufacturing items such as liquid crystal displays, EL (electro luminescence) displays, surface light emitting displays, color filters and the like. Alternatively, it is also possible to be a liquid ejection device for ejecting bioorganic material used for biochip manufacturing, a liquid ejection device for ejecting a liquid that will be a sample used for a precision pipette, a textile printing device, a micro dispenser or the like. Furthermore, it is also possible to use a liquid ejection device for ejecting lubricating oil with a pinpoint on precision machines such as watches, cameras or the like, a liquid ejection device for ejecting a transparent resin liquid such a ultraviolet curing resin or the like for forming a miniature hemispheric lens (optical lens) used for optical communication elements or the like on a substrate, or a liquid ejection device for ejecting an acid or alkaline or the like etching fluid for etching a substrate or the like. Then, it is possible to apply the present invention to any one type of liquid ejection device among these.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A liquid ejection device comprising:

a transport unit configured and arranged to transport an ejection medium;

a medium support unit arranged on a downstream side of the transport unit with respect to a transport direction of the ejection medium, and having a medium support surface on which the ejection medium is supported by suction using negative pressure when the transport unit transports the ejection medium; and a liquid ejection head configured and arranged to eject liquid on the ejection medium supported on the medium support unit, the medium support unit including a plurality of first recesses and a plurality of second recesses arranged on the medium support surface along a width direction orthogonal to the transport direction, the first recesses and the second recesses being configured and arranged to be imparted with the negative pressure, each of the first recesses having at least a first upstream side wall edge and a downstream side wall edge that define a first opening of each of the first recesses, the first upstream side wall edge being arranged at an upstream end of each of the first recesses with respect to the transport direction, the downstream side wall edge being arranged at a downstream end of each of the first recesses with respect to the transport direction, the second recesses being configured and arranged to accept the liquid ejected toward the ejection medium from the liquid ejection head, each of the second recesses having at least a first side wall edge and a second side wall edge that define a second opening of each of the second recesses and extend along the transport direction, wherein, in the first recesses, a width dimension of the downstream side wall edge of each of the first recesses in the width direction is larger than a width dimension of the upstream side wall edge of each of the first recesses in the width direction, and a width length between the first side wall edge and the second side wall edge of each of the second recesses in the width direction is smaller than the width dimension of the downstream side wall edge of each of the first recesses in the width direction.

2. The liquid ejection device according to claim 1, wherein each of the first recesses includes a first rib extending from the upstream side wall edge of each of the first recesses toward the downstream side with respect to the transport direction, and each of the first recesses further has a third side wall edge that defines the first opening and extends along the transport direction, a width length between the third side wall edge of each of the first recesses and the first rib of each of the first recesses in the width direction is smaller than the width length between the first side wall edge and the second side wall edge of each of the second recesses.

3. The liquid ejection device according to claim 2, wherein each of the first recesses further includes a second rib extending from the upstream side wall edge of each of the first recesses toward the downstream side with respect to the transport direction.

4. The liquid ejection device according to claim 2, wherein the third side wall edge has a step shape as viewed in a vertical direction that is orthogonal to the transport direction and the width direction.

5. The liquid ejection device according to claim 4, wherein each of the first recesses further has a fourth side wall edge that defines the first opening, is opposite the third side wall edge in the width direction, and extends along the transport direction, and the fourth side wall edge has a step shape as viewed in a vertical direction that is orthogonal to the transport direction and the width direction.

6. The liquid ejection device according to claim 1, wherein each of the second recesses further has a second upper stream side wall edge that is arranged at an upstream side of each of the second recesses with respect to the transport direction, defines the second opening, and extends along the width direction, and the second upstream side wall edge of each of the second recesses is positioned on the upstream side than the first upstream side wall edge of each of the first recesses with respect to the transport direction.

7. The liquid ejection device according to claim 1, wherein the second recesses are arranged at positions respectively corresponding to end parts of the ejection medium in the width direction.

8. The liquid ejection device according to claim 1, wherein at least one of the first recesses includes a suction hole in communication with a negative pressure generating unit that generates the negative pressure.

9. A liquid ejection device comprising a transport unit configured and arranged to transport an ejection medium;

a medium support unit arranged on a downstream side of the transport unit with respect to a transport direction of the ejection medium, and having a medium support surface on which the ejection medium is supported by suction using negative pressure when the transport unit transports the ejection medium; and a liquid ejection head configured and arranged to eject liquid on the ejection medium supported on the medium support unit, the medium support unit including a plurality of first recesses and a plurality of second recesses arranged on the medium support surface along a width direction orthogonal to the transport direction, the first recesses and the second recesses being configured and arranged to be imparted with the negative pressure, each of the first recesses having at least an upstream side wall edge and a downstream side wall edge that define a first opening of each of the first recesses, the upstream side wall edge being arranged at an upstream end of each of the first recesses with respect to the transport direction, the downstream side wall edge being arranged at a downstream end of each of the first recesses with respect to the transport direction, the second recesses being configured and arranged to accept the liquid ejected toward the ejection medium from the liquid ejection head, a width dimension of the downstream side wall edge of each of the first recesses in the width direction being larger than a width dimension of the upstream side wall edge of each of the first recesses in the width direction, and a groove part formed on the medium support surface and connecting one of the second recesses and the at least one of the first recesses so that the negative pressure is imparted to the one of the second recesses through the groove part, the at least one of the first recesses and the suction hole, and wherein each of the second recesses has at least a first side wall edge and a second side wall edge that define a second opening of each of the second recesses and extend along the transport direction, and a width length between the first side wall edge and the second side wall edge of each of the second recesses in the width direction is smaller than the width dimension of the downstream side wall edge of each of the first recesses in the width direction.

* * * * *